US006439324B1

(12) United States Patent
Ringgenberg et al.

(10) Patent No.: US 6,439,324 B1
(45) **Date of Patent: *Aug. 27, 2002**

(54) ELECTRICALLY INSULATING GAP SUBASSEMBLY FOR DOWNHOLE ELECTROMAGNETIC TRANSMISSION

(75) Inventors: Paul D. Ringgenberg, Carrollton; Harrison C. Smith, Anna, both of TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/539,457

(22) Filed: Mar. 30, 2000

Related U.S. Application Data

(62) Division of application No. 09/036,886, filed on Mar. 5, 1998, now Pat. No. 6,098,727.

(51) Int. Cl.[7] ..... E21B 17/02

(52) U.S. Cl. ..... 175/325.2; 166/242.6; 166/380; 285/52

(58) Field of Search ..... 285/47, 48, 50, 285/52, 39.8, 53; 166/242.6, 380; 175/325.2, 325.4, 325.5, 325.6; 174/138 D, 138 A

(56) References Cited

U.S. PATENT DOCUMENTS

| | | | | | |
|---|---|---|---|---|---|
| 1,494,693 | A | | 3/1924 | Loi | 285/45 |
| 2,400,170 | A | | 5/1946 | Silverman | 177/351 |
| 2,758,818 | A | * | 8/1956 | Kammerer | 175/327 |
| 2,940,787 | A | * | 6/1960 | Goodner | 403/47 |
| 4,348,672 | A | | 9/1982 | Givier | 340/854 |
| 4,387,372 | A | | 6/1983 | Smith et al. | 340/854 |
| 4,459,597 | A | | 7/1984 | Blaese | 343/900 |
| 4,496,174 | A | | 1/1985 | McDonald et al. | 285/53 |
| 4,579,373 | A | | 4/1986 | Neal et al. | 285/47 |
| 4,589,187 | A | | 5/1986 | Stone et al. | 29/458 |
| 4,616,702 | A | | 10/1986 | Hanson et al. | 166/65.1 |
| 4,674,773 | A | | 6/1987 | Stone et al. | 285/48 |
| 4,788,544 | A | | 11/1988 | Howard | 340/853 |
| 4,845,493 | A | | 7/1989 | Howard | 340/853 |
| 5,083,821 | A | * | 1/1992 | Friend | 285/355 |
| 5,130,706 | A | | 7/1992 | Van Steenwyk | 340/854.6 |
| 5,138,313 | A | | 8/1992 | Barrington | 34/854.6 |
| 5,159,978 | A | * | 11/1992 | Tomek et al. | 166/254.2 |
| 5,160,925 | A | | 11/1992 | Dailey et al. | 340/853.3 |
| 5,163,714 | A | | 11/1992 | Issenmann | 285/54 |
| 5,396,232 | A | | 3/1995 | Mathiew et al. | 340/854.5 |
| 5,467,083 | A | | 11/1995 | McDonald et al. | 340/854.6 |
| 5,749,605 | A | * | 5/1998 | Hampton, III et al. | 285/48 |

* cited by examiner

*Primary Examiner*—David Bagnell
*Assistant Examiner*—John Kreck
(74) *Attorney, Agent, or Firm*—Michael D. McCully; Lawrence R. Youst

(57) ABSTRACT

An electrically insulating gap subassembly for inclusion in a pipe string (30) comprising a pair of tubular members (90, 98) having an electrically insulating isolation subassembly (94) threadably disposed therebetween is disclosed. The electrically insulating isolation subassembly (94) has an anodized aluminum surface that provides electrical isolation to interrupt electrical contact between the two tubular members (90, 98) such that electromagnetic waves (46, 54) carrying information may be generated thereacross.

31 Claims, 2 Drawing Sheets

ELECTRICALLY INSULATING GAP SUBASSEMBLY FOR DOWNHOLE ELECTROMAGNETIC TRANSMISSION

RELATED APPLICATIONS

This nonprovisional application is a divisional of United States nonprovisional Patent application: application Ser. No. 09/036,886 filed Mar. 5, 1998 by Paul D. Ringgenberg et al. for "Electrically Insulating Gap Subassembly for Downhole Electromagnetic Transmission," now U.S. Pat. No. 6,098,727.

TECHNICAL FIELD OF THE INVENTION

This invention relates in general to downhole telemetry and, in particular to, an electrically insulating gap subassembly for electrically insulating sections of a pipe string such that electromagnetic waves may be developed thereacross for carrying information between surface equipment and downhole equipment.

BACKGROUND OF THE INVENTION

Without limiting the scope of the present invention, its background is described in connection with transmitting downhole data to the surface during measurements while drilling (MWD), as an example. It should be noted that the principles of the present invention are applicable not only during drilling, but throughout the life of a wellbore including, but not limited to, during logging, testing, completing and producing the well.

Heretofore, in this field, a variety of communication and transmission techniques have been attempted to provide real time data from the vicinity of the bit to the surface during drilling. The utilization of MWD with real time data transmission provides substantial benefits during a drilling operation. For example, continuous monitoring of downhole conditions allows for an immediate response to potential well control problems and improves mud programs.

Measurement of parameters such as bit weight, torque, wear and bearing condition in real time provides for a more efficient drilling operation. In fact, faster penetration rates, better trip planning, reduced equipment failures, fewer delays for directional surveys, and the elimination of a need to interrupt drilling for abnormal pressure detection is achievable using MWD techniques.

At present, there are four major categories of telemetry systems that have been used in an attempt to provide real time data from the vicinity of the drill bit to the surface, namely mud pressure pulses, insulated conductors, acoustics and electromagnetic waves.

In a mud pressure pulse system, the resistance of mud flow through a drill string is modulated by means of a valve and control mechanism mounted in a special drill collar near the bit. This type of system typically transmits at 1 bit per second as the pressure pulse travels up the mud column at or near the velocity of sound in the mud. It has been found, however, that the rate of transmission of measurements is relatively slow due to pulse spreading, modulation rate limitations, and other disruptive limitations such as the requirement of mud flow.

Insulated conductors, or hard wire connection from the bit to the surface, is an alternative method for establishing downhole communications. This type of system is capable of a high data rate and two way communications are possible. It has been found, however, that this type of system requires a special drill pipe and special tool joint connectors which substantially increase the cost of a drilling operation. Also, these systems are prone to failure as a result of the abrasive conditions of the mud system and the wear caused by the rotation of the drill string.

Acoustic systems have provided a third alternative. Typically, an acoustic signal is generated near the bit and is transmitted through the drill pipe, mud column or the earth. It has been found, however, that the very low intensity of the signal which can be generated downhole, along with the acoustic noise generated by the drilling system, makes signal detection difficult. Reflective and refractive interference resulting from changing diameters and thread makeup at the tool joints compounds the signal attenuation problem for drill pipe transmission.

The fourth technique used to telemeter downhole data to the surface uses the transmission of electromagnetic waves through the earth. A current carrying downhole data is input to a toroid or collar positioned adjacent to the drill bit or input directly to the drill string. An electromagnetic receiver is inserted into the ground at the surface where the electromagnetic data is picked up and recorded. It has been found, however, that it is necessary to have an electrically insulated subassembly in the drill string in order to generate the electromagnetic waves. Conventional electromagnetic systems have used dielectric materials such as plastic resins between the threads of drill pipe joints or within sections of drill pipe. It has been found, however, that these dielectric materials may be unable to withstand the extreme tensile, compressive and torsional loading that occurs during a drilling operation.

Therefore, a need has arisen for a gap subassembly that electrically isolates portions of a drill string and that is capable of being used for telemetering real time data from the vicinity of the drill bit in a deep or noisy well using electromagnetic waves to carry the information. A need has also arisen for a gap subassembly that is capable of withstanding the extreme tensile, compressive and torsional loading that occurs during a drilling operation.

SUMMARY OF THE INVENTION

The present invention disclosed herein comprises an electrically insulating gap subassembly that electrically isolates portions of a drill string that is capable of being used for telemetering real time data from the vicinity of the drill bit in a deep or noisy well using electromagnetic waves to carry the information. The apparatus of the present invention is capable of withstanding the extreme tensile, compressive and torsional loading that occurs during a downhole operation such as drilling a wellbore that traverses a hydrocarbon formation and production of hydrocarbons from the formation.

The electrically insulating gap subassembly of the present invention comprises first and second tubular members each having a threaded end connector. An isolation subassembly having first and second threaded end connectors is disposed therebetween and respectively coupled to the threaded end connectors of the first and second tubular members. The isolation subassembly may be made of aluminum and have anodized surfaces.

The electrically insulating gap subassembly may include an outer sleeve disposed exteriorly about the isolation subassembly. The outer sleeve may extend exteriorly about a portion of the first and second tubular members. The electrically insulating gap subassembly may also include an inner sleeve disposed interiorly within the isolation subassembly. The inner sleeve may extend interiorly within a portion of the first and second tubular members. The inner sleeve and the outer sleeve are composed of an insulating material such as fiberglass. A glue may be used to attach the inner sleeve and the outer sleeve to the isolation subassembly.

The electrically insulating gap subassembly may have an insulating coating between the threaded end connectors of the first and second tubular members and the isolation subassembly. The insulating coating may be, for example, a ceramic or aluminum oxide.

The electrically insulating gap subassembly of the present invention may include a dielectric material disposed between the isolation subassembly and the first and second tubular members. In this embodiment, an electrically conductive isolation subassembly constructed from, for example steel, may be used.

BRIEF DESCRIPTION OF THE DRAWINGS

For a more complete understanding of the present invention, including its features and advantages, reference is now made to the detailed description of the invention, taken in conjunction with the accompanying drawings of which.

DETAILED DESCRIPTION OF THE INVENTION

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the invention.

Figure 1:
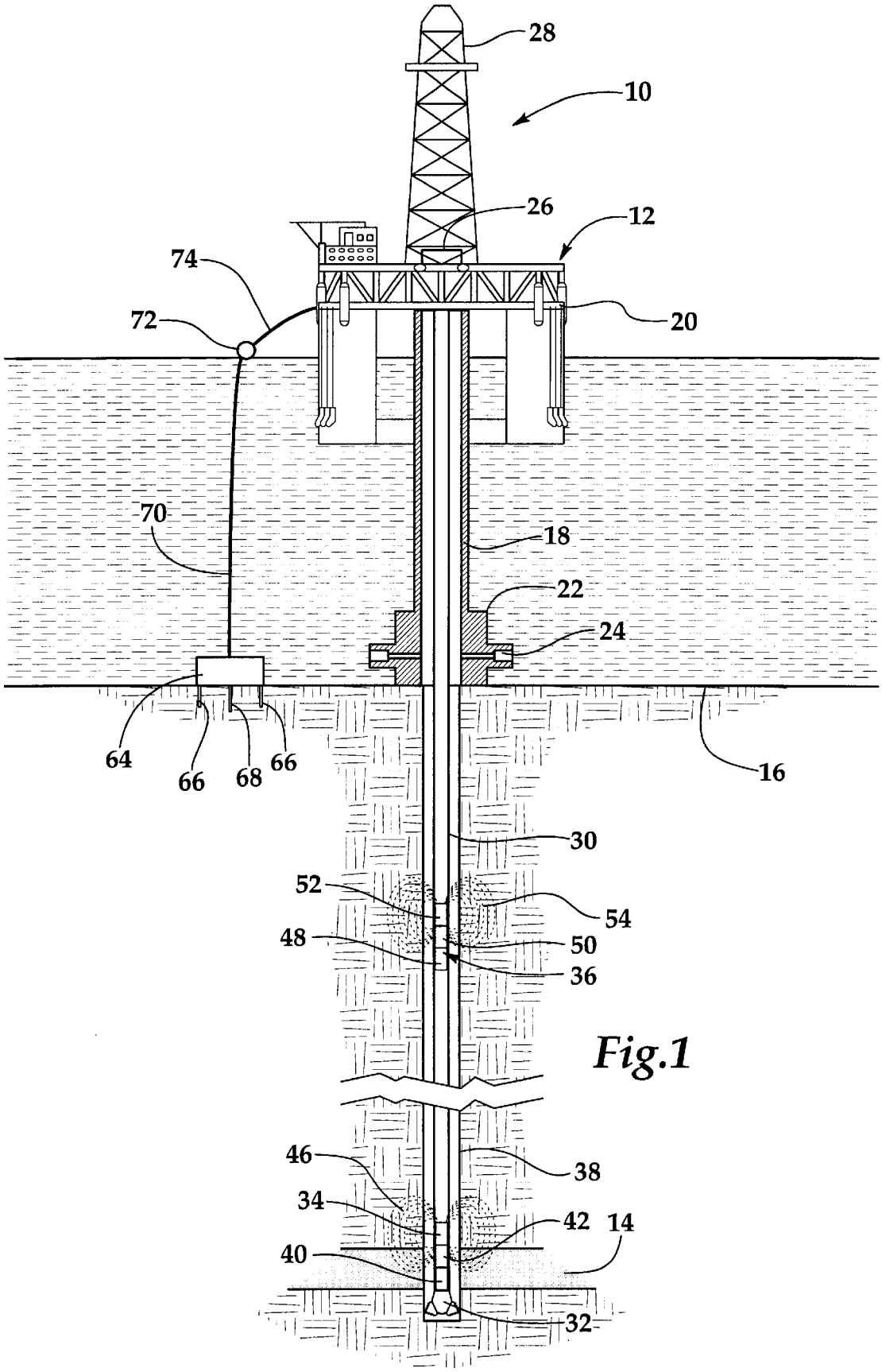
FIG. 1 is a schematic illustration of an offshore oil or gas drilling platform operating isolation subassemblies of the present invention.

Referring to FIG. 1, a downhole electromagnetic signal transmitter and a downhole electromagnetic signal repeater in use in conjunction with an offshore oil and gas drilling operation are schematically illustrated and generally designated 10. A semi-submersible platform 12 is centered over a submerged oil and gas formation 14 located below sea floor 16. A subsea conduit 18 extends from deck 20 of platform 12 to wellhead installation 22 including blowout preventers 24. Platform 12 has a hoisting apparatus 26 and a derrick 28 for raising and lowering drill string 30, including drill bit 32, electromagnetic transmitter 34 and downhole electromagnetic signal repeater 36.

In a typical drilling operation, drill bit 32 is rotated by drill string 30, such that drill bit 32 penetrates through the various earth strata, forming wellbore 38. Measurement of parameters such as bit weight, torque, wear and bearing conditions may be obtained by sensors 40 located in the vicinity of drill bit 32. Additionally, parameters such as pressure and temperature as well as a variety of other environmental and formation information may be obtained by sensors 40. The signal generated by sensors 40 may typically be analog, which must be converted to digital data before electromagnetic transmission in the present system. The signal generated by sensors 40 is passed into an electronics package 42 including an analog to digital converter which converts the analog signal to a digital code utilizing "ones" and "zeros" for information transmission.

Electronics package 42 may also include electronic devices such as an on/off control, a modulator, a microprocessor, memory and amplifiers. Electronics package 42 is powered by a battery pack which may include a plurality of batteries, such as nickel cadmium or lithium batteries, which are configured to provide proper operating voltage and current.

Once the electronics package 42 establishes the frequency, power and phase output of the information, electronics package 42 feeds the information to electromagnetic transmitter 34. Electromagnetic transmitter 34 may be a direct connect to drill string 30 or may electrically approximate a large transformer. The information is then carried uphole in the form of electromagnetic wave fronts 46 which propagate through the earth. These electromagnetic wave fronts 46 are picked up by receiver 48 of electromagnetic repeater 36 located uphole from electromagnetic transmitter 34.

Electromagnetic repeater 36 is spaced along drill string 30 to receive electromagnetic wave fronts 46 while electromagnetic wave fronts 46 remain strong enough to be readily detected. Receiver 48 of electromagnetic repeater 36 may electrically approximate a large transformer. As electromagnetic wave fronts 46 reach receiver 48, a current is induced in receiver 48 that carries the information originally obtained by sensors 40.

The current from receiver 48 is fed to an electronics package 50 that may include a variety of electronic devices such as amplifiers, limiters, filters, a phase lock loop, shift registers and comparators. Electronics package 50 processes the signal and amplifies the signal to reconstruct the original waveform, compensating for losses and distortion occurring during the transmission of electromagnetic wave fronts 46 through the earth. Electronics package 50 forwards the signal to a transmitter 52 that generates and radiates electromagnetic wave fronts 54 into the earth in the manner described with reference to transmitter 44 and electromagnetic wave fronts 46.

Electromagnetic wave fronts 54 are received by electromagnetic pickup device 64 located on sea floor 16. Electromagnetic pickup device 64 may sense either the electric field or the magnetic field of electromagnetic wave front 54 using electric field sensors 66 or a magnetic field sensor 68 or both.

Electromagnetic pickup device 64 then transmits the information received in electromagnetic wave fronts 54 to the surface via wire 70 that is connected to buoy 72 and wire 74 that is connected to a processor on platform 12. Upon reaching platform 12, the information originally obtained by sensors 40 is further processed making any necessary calculations and error corrections such that the information may be displayed in a usable format.

Even though FIG. 1 depicts a single repeater 36, it should be noted by one skilled in the art that the number of repeaters, if any, located within drill string 30 will be determined by the depth of wellbore 38, the noise level in wellbore 38 and the characteristics of the earth's strata adjacent to wellbore 38 in that electromagnetic waves suffer from attenuation with increasing distance from their source at a rate that is dependent upon the composition characteristics of the transmission medium and the frequency of transmission. For example, repeaters, such as repeater 36, may be positioned between 2,000 and 5,000 feet apart. Thus, if wellbore 38 is 15,000 feet deep, between two and seven repeaters would be desirable.

Even though FIG. 1 depicts transmitter 34, repeater 36 and electromagnetic pickup device 64 in an offshore environment, it should be understood by one skilled in the art that transmitter 34, repeater 36 and electromagnetic pickup device 64 are equally well-suited for operation in an onshore environment. In fact, in an onshore environment, electromagnetic pickup device 64 would be placed directly on the land. Alternatively, a receiver such as receiver 48 could be used at the surface to pick up the electromagnetic wave fronts for processing at the surface.

Additionally, while FIG. 1 has been described with reference to transmitting information uphole during a measurement while drilling operation, it should be understood by one skilled in the art that repeater 36 and electromagnetic pickup device 64 may be used in conjunction with the transmission of information downhole from surface equipment to downhole tools to perform a variety of functions such as opening and closing a downhole tester valve or controlling a downhole choke. In this example, transmitter 34 would also serve as an electromagnetic receiver.

Further, even though FIG. 1 has been described with reference to one way communication from the vicinity of drill bit 32 to platform 12, it should be understood by one skilled in the art that the principles of the present invention are applicable to two way communications. For example, a surface installation may be used to request downhole pressure, temperature, or flow rate information from formation 14 by sending electromagnetic wave fronts downhole using electromagnetic pickup device 64 as an electromagnetic transmitter and retransmitting the request using repeater 36 as described above. Electromagnetic transmitter 34, serving as an electromagnetic receiver, would receive the electromagnetic wave fronts and pass the request to sensors, such as sensors 40, located near formation 14. Sensors 40 then obtain the appropriate information which would be returned to the surface via electromagnetic wave fronts 46 which would again be retransmitted by repeater 36. As such, the phrase "between surface equipment and downhole equipment" as used herein encompasses the transmission of information from surface equipment downhole, from downhole equipment uphole or for two way communications.

Figure 2A:
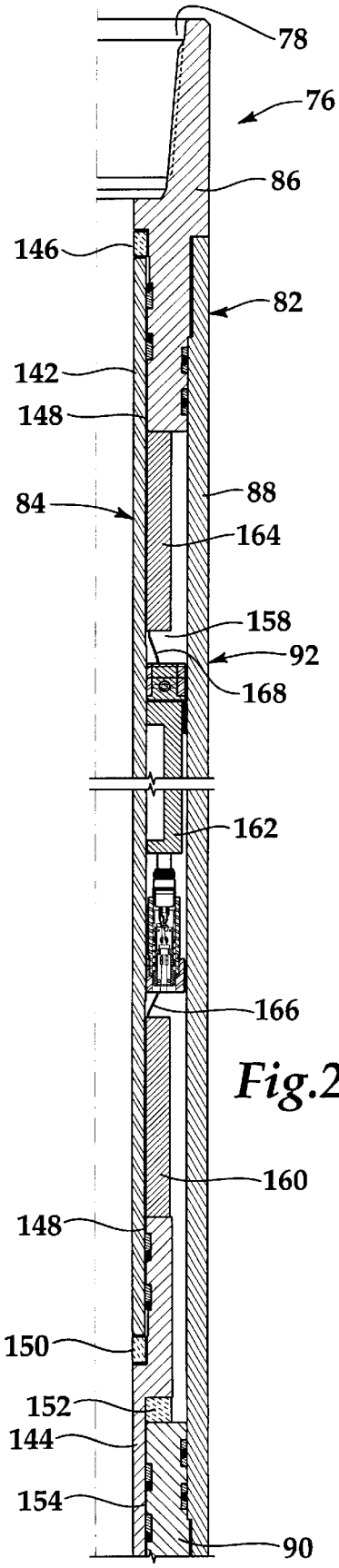
FIGS. 2A–2B are quarter-sectional views of a downhole electromagnetic transmitter and receiver utilizing an isolation subassembly of the present invention.
Figure 2B:
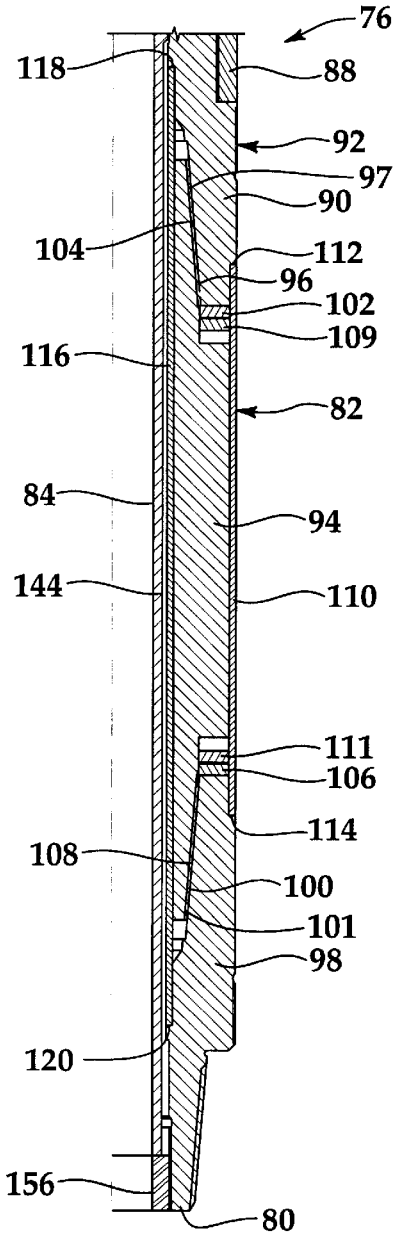

Representatively illustrated in FIGS. 2A–2B is one embodiment of an electromagnetic transmitter and receiver, such as electromagnetic transmitter 34, or a downhole electromagnetic signal repeater, such as repeater 36, which is generally designated 76 and which will hereinafter be referred to as repeater 76. For convenience of illustration, FIGS. 2A–2B depict repeater 76 in a quarter sectional view. Repeater 76 has a box end 78 and a pin end 80 such that repeater 76 is threadably adaptable to drill string 30. Repeater 76 has an outer housing 82 and a mandrel 84 having a full bore so that when repeater 76 is interconnected with drill string 30, fluids may be circulated therethrough and therearound. Specifically, during a drilling operation, drilling mud is circulated through drill string 30 inside mandrel 84 of repeater 76 to ports formed through drill bit 32 and up the annulus formed between drill string 30 and wellbore 38 exteriorly of housing 82 of repeater 76. Housing 82 and mandrel 84 thereby protect the operable components of repeater 76 from drilling mud or other fluids disposed within wellbore 38 and within drill string 30.

Housing 82 of repeater 76 includes an axially extending generally tubular upper connecter 86 which has box end 78 formed therein. Upper connecter 86 may be threadably and sealably connected to drill string 30 for conveyance into wellbore 38.

An axially extending generally tubular intermediate housing member 88 is threadably and sealably connected to upper connecter 86. An axially extending generally tubular lower housing member 90 is threadably and sealably connected to intermediate housing member 88. Collectively, upper connector 86, intermediate housing member 88 and lower housing member 90 form upper subassembly 92. Upper subassembly 92 is electrically connected to the section of drill string 30 above repeater 76.

An axially extending generally tubular isolation subassembly 94 is securably and sealably coupled to lower housing member 90 by outer threads 96 and inner threads 97. An axially extending generally tubular lower connector 98 is securably and sealably coupled to isolation subassembly 94 by outer threads 100 and inner threads 101.

Dielectric member 102 is disposed between the isolation subassembly 94 and lower housing number 90. Dielectric material 104 is disposed between outer threads 97 of isolation subassembly 94 and inner threads 96 of lower housing member 90. Dielectric member 102 and dielectric material 104 are electrically insulating materials that provide substantial load bearing capabilities such as a ceramic, anodized aluminum or a resin such as mycarta. Similarly, dielectric member 106 is disposed between isolation subassembly 94 and the lower connector 98 while dielectric material 108 is disposed between outer threads 100 of isolation subassembly 94 and inner threads 101 of lower connector 98.

Isolation subassembly 94 may be made of aluminum having a strength of, for example, a 60,000 psi. Isolation subassembly 94 may be anodized to confers an electrically insulating coating on the surface of isolation subassembly 94.

An outer sleeve 110 is disposed exteriorly of isolation subassembly 94, lower housing member 90 and lower connector 98 between shoulder 112 of lower housing member 90 and shoulder 114 of lower connector 98. Outer sleeve 110 is formed from an electrically insulating material, such as pre-formed or built-up fiberglass. Outer sleeve 110 has the same outer diameter as the lower housing member 90 and lower connector 98. Outer sleeve 110 provides insulation to isolation subassembly 94 and protects isolation subassembly 94 from corrosion and contact with the sides of wellbore 38 and rig tongs when isolation subassembly 94 is joined with other sections of drill string 30.

An inner sleeve 116 is disposed on the inner surface of isolation subassembly 94, and extends into lower housing member 90 and lower connector 98 between shoulder 118 of lower housing member 90 and shoulder 120 of lower connector 98. Inner sleeve 116 is an electrical insulator that helps protect the inner surface of isolation subassembly 94 from, e.g., drilling mud and other corrosive materials.

The contact points between the isolation subassembly 94 and lower housing member 90 and lower connector 98, respectively, are electrically insulated in several ways. Specifically, the outer surface of isolation subassembly 94 may be anodized aluminum and dielectric members 102, 106 along with dielectric material 104, 108 provide electric isolation between isolation subassembly 94, lower housing member 90 and lower connector 98. In addition, inner threads 97 of lower housing member 90 and inner threads 101 of lower connector 98, which are made of steel, may be coated with an insulating material. For example, insulating materials such as ceramic, Polytetrafluoroethylene or an aluminum oxide coating are suitable.

Outer sleeve 110 and inner sleeve 116 also provide electrical insulation between isolation subassembly 94, lower housing member 90 and lower connector 98. In addition to protecting isolation subassembly 94 from potential damage during handling and use such as scratching, outer sleeve 110 and inner sleeve 194, also provide for corrosion protection for the anodized aluminum isolation subassembly 94.

Alternatively, with the use of dielectric members 102, 106 along with dielectric material 104, 108, sufficient electrical isolation may be obtained using an electrically conductive isolation subassembly 94 constructed from, for example, steel, that is disposed between lower housing member 90 and lower connector 98. In this embodiment, a suitable insulating material such as ceramic, Polytetrafluoroethylene or an aluminum oxide coating may be placed between inner threads 97 of lower housing member 90 and outer threads 96 of isolation subassembly 94 as well as between inner threads 101 of lower connector 98 and outer threads 100 of isolation subassembly 94. Also, in this embodiment, the distance between the dielectric members 102, 106 is preferably at least two diameters of isolation subassembly 94.

In the past, when an insulating coating was applied to threads, the contact stress of torquing the joint commonly damaged the coating. Isolation subassembly 94 of the present invention provides a modified shoulder that allows the threads to be made up manually and then permits the threads to be loaded. Specifically, collar 109 may be used to load outer threads 96 of isolation subassembly 94 and inner threads 97 of lower housing member 90. First, isolation subassembly 94 and lower housing member 90 are mated together without applying full torque. Thereafter, collar 109 is rotated on outer thread 96 of isolation subassembly 94 toward lower housing member 90, thereby loading outer threads 96 and inner threads 97 without damaging the insulating coating. Likewise, collar 111 may be used to load outer threads 100 of isolation subassembly 94 and inner threads 101 of lower connector 98 in a similar manner. This procedure allows for the loading of outer threads 100 and inner threads 101 without any sliding action to damage the coating. Collars 109, 111 may be locked into place using set screws.

Alternatively, isolation subassembly 94 may be coupled with lower housing member 90 and lower connector 98 using thermal torque. Outer threads 96, 100 of the isolation subassembly 94 are cooled, while inner threads 97 of lower housing member 90 and inner threads 101 of lower connector 98 are heated. The respective threads are then joined together and torqued to a low value. As outer threads 96, 100 of isolation subassembly 94 heat up and while inner threads 97 of lower housing member 90 and inner threads 101 of lower connector 98 cool, a load is created on the threads. By using the thermal torque assembly method, a large load may be placed on outer threads 96, 100 of isolation subassembly 94 while eliminating the contact stress associated with high torque that can cause scratching of the anodized aluminum outer threads 96, 100 of the isolation subassembly 94 and the coated steel inner threads 97, 101 of lower housing member 90 and lower connector 98, respectively.

Additionally, it should be noted by one skilled in the art that the threaded connections of isolation subassembly 94 may be further strengthened by the addition of an epoxy therebetween, such as HalliBurton WELD A. Likewise, dielectric members 102, 106 and dielectric material 104, 108 as well as outer sleeve 110 and inner sleeve 116 may be secured in place using an epoxy.

Thus, isolation subassembly 94 provides a discontinuity in the electrical connection between lower connector 98 and upper subassembly 92 of repeater 76, thereby providing a discontinuity in the electrical connection between the portion of drill string 30 below repeater 76 and the portion of drill string 30 above repeater 76.

It should be apparent to those skilled in the art that the use of directional terms such as above, below, upper, lower, upward, downward, etc. are used in relation to the illustrative embodiments as they are depicted in the figures, the upward direction being toward the top of the corresponding figure and the downward direction being toward the bottom of the corresponding figure. It is to be understood that repeater 76 may be operated in vertical, horizontal, inverted or inclined orientations without deviating from the principles of the present invention.

Mandrel 84 includes axially extending generally tubular upper mandrel section 142 and axially extending generally tubular lower mandrel section 144. Upper mandrel section 142 is partially disposed and sealing configured within upper connector 86. A dielectric member 146 electrically isolates upper mandrel section 142 from upper connector 86. The outer surface of upper mandrel section 142 may have a dielectric layer 148 disposed thereon. Dielectric layer 148 may be, for example, a Polytetrafluoroethylene layer. Together, dielectric layer 148 and dielectric member 146 serve to electrically isolate upper connector 86 from upper mandrel section 142.

Between upper mandrel section 142 and lower mandrel section 144 is a dielectric member 150 that, along with dielectric layer 148, serves to electrically isolate upper mandrel section 142 from lower mandrel section 144. Between lower mandrel section 144 and lower housing member 90 is a dielectric member 152. On the outer surface of lower mandrel section 144 is a dielectric layer 154 which, along with dielectric member 152, provides for electric isolation of lower mandrel section 144 from lower housing number 90. Dielectric layer 154 also provides for electric isolation between lower mandrel section 144 and isolation subassembly 94 as well as between lower mandrel section 144 and lower connector 98. Lower end 156 of lower mandrel section 144 is disposed within lower connector 98 and is in electrical communication with lower connector 98.

Intermediate housing member 88 of outer housing 82 and upper mandrel section 142 of mandrel 84 define annular area 158. A receiver 160, an electronics package 162 and a transmitter 164 are disposed within annular area 158. In operation, receiver 160 receives an electromagnetic input signal carrying information which is transformed into an electrical signal that is passed onto electronics package 162 via electrical conductor 166. Electronics package 162 processes and amplifies the electrical signal. The electrical signal is then fed to transmitter 164 via electrical conductor 168. Transmitter 164 transforms the electrical signal into an electromagnetic output signal carrying information that is radiated into the earth utilizing isolation subassembly 94 to provide the electrical discontinuity necessary to generate the electromagnetic output signal.

While this invention has been described with a reference to illustrative embodiments, this description is not intended to be construed in a limiting sense. Various modifications and combinations of the illustrative embodiments as well as other embodiments of the invention, will be apparent to persons skilled in the art upon reference to the description. It is, therefore, intended that the appended claims encompass any such modifications or embodiments.

What is claimed is:

1. An electrically insulating gap subassembly for inclusion in a pipe string comprising:

a first tubular member having a threaded end connector;

a second tubular member having a threaded end connector;

an electrically insulating isolation subassembly having first and second threaded end connectors, the first threaded end connector of the isolation subassembly threadably coupled to the threaded end connector of the first tubular member and the second threaded end connector of the isolation subassembly threadably coupled to the threaded end connector of the second tubular member; and first and second electrically insulating members disposed respectively between the isolation subassembly and the first and second tubular members.

2. The electrically insulating gap subassembly as recited in claim 1, wherein the electrically insulating isolation subassembly has an anodized surface.

3. The electrically insulating gap subassembly as recited in claim 1, further comprising an outer sleeve disposed exteriorly about the electrically insulating isolation subassembly.

4. The electrically insulating gap subassembly as recited in claim 3, wherein the outer sleeve extends exteriorly about a portion of the first tubular member.

5. The electrically insulating gap subassembly as recited in claim 4, wherein the outer sleeve extends exteriorly about a portion of the second tubular member.

6. The electrically insulating gap subassembly as recited in claim 3, wherein the outer sleeve is fiberglass.

7. The electrically insulating gap subassembly as recited in claim 1, further comprising an inner sleeve disposed interiorly within the electrically insulating isolation subassembly.

8. The electrically insulating gap subassembly as recited in claim 7, wherein the inner sleeve extends interiorly within a portion of the first tubular member.

9. The electrically insulating gap subassembly as recited in claim 8, wherein the inner sleeve extends interiorly within a portion of the second tubular member.

10. The electrically insulating gap subassembly as recited in claim 7, wherein the inner sleeve is fiberglass.

11. The electrically insulating gap subassembly as recited in claim 1, wherein the threaded end connectors of the first and second tubular members have an insulating coating thereon.

12. The electrically insulating gap subassembly as recited in claim 11, wherein the insulating coating is a ceramic.

13. The electrically insulating gap subassembly as recited in claim 11, wherein the insulating coating is aluminum oxide.

14. The electrically insulating gap subassembly as recited in claim 1 further comprising an electrically insulating material disposed between the first threaded connector of the electrically insulating isolation subassembly and the threaded connector of the first tubular member.

15. The electrically insulating gap subassembly as recited in claim 1 further comprising an electrically insulating material disposed between the second threaded connector of the electrically insulating isolation subassembly and the threaded connector of the second tubular member.

16. The electrically insulating gap subassembly as recited in claim 1, further comprising a collar rotatably disposed about the first threaded connector of the electrically insulating isolation subassembly for loading the threads of the first threaded connector of the electrically insulating isolation subassembly and the threads of the threaded connector of the first tubular member.

17. The electrically insulating gap subassembly as recited in claim 1, further comprising a collar rotatably disposed about the second threaded connector of the electrically insulating isolation subassembly for loading the threads of the second threaded connector of the electrically insulating isolation subassembly and the threads of the threaded connector of the second tubular member.

18. An electrically insulating gap subassembly for inclusion in a pipe string comprising:

a first tubular member having a threaded end connector;

a second tubular member having a threaded end connector;

an electrically insulating isolation subassembly having first and second threaded end connectors, the first threaded end connector of the electrically insulating isolation subassembly threadably coupled to the threaded end connector of the first tubular member and the second threaded end connector of the electrically insulating isolation subassembly threadably coupled to the threaded end connector of the second tubular member, wherein the electrically insulating isolation subassembly is made of aluminum;

an outer sleeve disposed exteriorly about the electrically insulating isolation subassembly; and an inner sleeve disposed interiorly within the electrically insulating isolation subassembly, wherein the inner sleeve is fiberglass.

19. The electrically insulating gap subassembly as recited in claim 18, wherein the electrically insulating isolation subassembly has an anodized surface.

20. The electrically insulating gap subassembly as recited in claim 18, wherein the outer sleeve extends exteriorly about a portion of the first and second tubular members.

21. The electrically insulating gap subassembly as recited in claim 18, wherein the outer sleeve is fiberglass.

22. The electrically insulating gap subassembly as recited in claim 18, wherein the inner sleeve extends interiorly within a portion of the first and second tubular members.

23. The electrically insulating gap subassembly as recited in claim 18, wherein the threaded end connectors of the first and second tubular members have an insulating coating thereon.

24. The electrically insulating gap subassembly as recited in claim 23, wherein the insulating coating is a ceramic.

25. The electrically insulating gap subassembly as recited in claim 23, wherein the insulating coating is aluminum oxide.

26. The electrically insulating gap subassembly as recited in claim 18, further comprising an electrically insulating member disposed between the electrically insulating isolation subassembly and the first tubular member.

27. The electrically insulating gap subassembly as recited in claim 18 further comprising an electrically insulating material disposed between the first threaded connector of the electrically insulating isolation subassembly and the threaded connector of the first tubular member.

28. The electrically insulating gap subassembly as recited in claim 18, further comprising an electrically insulating member disposed between the electrically insulating isolation subassembly and the second tubular member.

29. The electrically insulating gap subassembly as recited in claim 18 further comprising an electrically insulating material disposed between the second threaded connector of the electrically insulating isolation subassembly and the threaded connector of the second tubular member.

30. The electrically insulating gap subassembly as recited in claim 18, further comprising a collar rotatably disposed about the first threaded connector of the electrically insulating isolation subassembly for loading the threads of the first threaded connector of the electrically insulating isolation subassembly and the threads of the threaded connector of the first tubular member.

31. The electrically insulating gap subassembly as recited in claim 18, further comprising a collar rotatably disposed about the second threaded connector of the electrically insulating isolation subassembly for loading the threads of the second threaded connector of the electrically insulating isolation subassembly and the threads of the threaded connector of the second tubular member.

* * * * *